US006109894A

United States Patent [19]

Chatelain

[11] Patent Number: 6,109,894

[45] Date of Patent: Aug. 29, 2000

[54] DUAL PISTON PUMP DEVICE FOR FEEDING TWO INDEPENDENT LIQUIDS

[76] Inventor: Michel Chatelain, 10 rue Ramponnett, F-74940 Annecy le Vieux, France

[21] Appl. No.: 08/836,391

[22] PCT Filed: Nov. 6, 1995

[86] PCT No.: PCT/FR95/01452

§ 371 Date: Aug. 26, 1997

§ 102(e) Date: Aug. 26, 1997

[87] PCT Pub. No.: WO96/14496

PCT Pub. Date: May 17, 1996

[30] Foreign Application Priority Data

Nov. 7, 1994 [FR] France ..... 94 13507

[51] Int. Cl.[7] ..... F04B 23/04; F04B 19/00; F01B 1/00

[52] U.S. Cl. ..... 417/429; 417/470; 417/521; 92/72

[58] Field of Search ..... 417/429, 470, 417/521; 92/72

[56] References Cited

U.S. PATENT DOCUMENTS

| | | | |
|---|---|---|---|
| 2,059,758 | 11/1936 | Stearns | 417/454 |
| 2,697,403 | 12/1954 | Benedek | 417/439 |
| 2,980,023 | 4/1961 | Smith et al. | 417/382 |
| 3,385,221 | 5/1968 | Parks | 417/494 |
| 4,223,595 | 9/1980 | Ortelli | 92/72 |
| 5,509,347 | 4/1996 | De Jong et al. | 92/72 |

FOREIGN PATENT DOCUMENTS

| | | |
|---|---|---|
| 677993 | 12/1929 | France . |
| 3700599 | 7/1988 | Germany . |

*Primary Examiner*—Charles G. Freay
*Assistant Examiner*—Paul L. Ratcliffe
*Attorney, Agent, or Firm*—William A. Drucker

[57] ABSTRACT

A device consisting of two piston pumps for supplying two separate liquid systems, particularly a fuel injection system and an oil system in an internal combustion engine. The device includes a single housing containing the pump bodies; a single drive shaft (10) with cams (11) for controlling both pumps; an oil pump assembly (25) wherein each oil pump piston (20) is engaged by the cam (11) and urged away from the shaft (10), and biased in the opposite direction by a spring (23); and an injection pump piston assembly (30) moving perpendicularly to the oil pump pistons (20), wherein each injection pump piston (34) is engaged by a cam (11) and urged away then returned, by means of a C-shaped member (31) of which the open side faces the corresponding oil pump piston (20), and the ends of said C-shaped member (31) comprise a piston guide (33) and a piston rod (32) respectively, said rod and guide being coaxial and each piston rod (32) being slidable in a cylinder (35) with a port (45) that defines the start of injection with one end of the rod (32) having a sloping surface (47), and the end of injection with a hole (42) in the rod (32).

9 Claims, 3 Drawing Sheets

DUAL PISTON PUMP DEVICE FOR FEEDING TWO INDEPENDENT LIQUIDS

TECHNICAL FIELD

The present invention concerns a piston pump for feeding two independent liquid circuits and in particular the fuel injection circuit and the circuit for lubricating an internal combustion engine. The invention in particular concerns a straight-through shaft pump.

PRIOR ART

The injection and lubrication functions are conventionally provided by two separate devices.

As regards lubrication, this is ensured on the engines by an oil pump driven directly or by gears via the rotation movement of the crankshaft.

Secondly, the feeding of each cylinder with fuel or injection is provoked by an <<injection>> pump. On conventionally designed engines, this pump comprises a plurality of pistons driven by a camshaft and recalled by springs. Recall by springs clearly limits the maximum speed of the pump, absorbs a great deal of power, is extremely noisy and results in overheating.

To sum up, injection and lubrication are ensured by two separate devices which increases the overall cost and in particular limits accessibility.

The invention is able to mitigate these drawbacks.

SUMMARY OF THE INVENTION

The invention concerns a pump providing the functions of an oil pump for lubricating the engine and an injection pump for feeding said engine with fuel.

The invention thus concerns a device constituted by two piston pumps for feeding two independent liquid circuits, namely the fuel injection circuit and the oil circuit for internal combustion engines, characterised in that it includes:

- a single housing in which the pump bodies are fixed;
- a single cam drive shaft to control the two pumps;
- a set of oil pump pistons, each oil pump piston cooperating with the cam for movement by moving the shaft further away and recalled by a spring;
- a set of injection pump pistons whose movement is perpendicular to the movement of the oil pump pistons, each injection pump piston cooperating for thrusting and recall with a cam with the aide of a half-ring whose opening is directed towards the corresponding oil pump piston, and the extremities of said half-ring respectively comprising a piston guide and a piston rod, the rod and the guide being placed with one being an extension of the other, each piston rod sliding in a cylinder comprising an aperture defining the start of injection with one extremity of the slanted ramp-shaped rod, and the end of injection with a hole provided on the rod.

In practice, it preferably includes a monoblock injection cylinder head connecting all the cylinders via locking on the monoblock housing;

- each cylinder is able to move inside a cylinder cover whose position with respect to the cylinder is adjusted by a screw;
- the monoblock injection cylinder head comprises opposite the cylinder a compression chamber receiving the valve and its spring and opening onto the outlet of two injectors;

- control of variation of the injection pump flowrate is obtained via the pistons rotating on their axis, said rotation being controlled from the back of the half-rings on which two arms are machined with a throat, said half-rings receiving a welded needle parallel to the axis of the piston and able to cooperate with a rack disposed parallel to the camshaft;
- the housing includes a cover secured to the remainder of the housing and which comprises a slide and aperture able to allow the finger of the rack to move towards the regulator;
- the finger of the rack is controlled by a speed regulator secured to the cover of the housing;
- the slanted ramp of the rod, the hole provided on the rod and the aperture of the cylinder are disposed so that injection is effected on both sides of the half-travel of the piston when its linear speed is greater;
- one of the extremities of the camshaft can be connected directly to the crankshaft, whereas the other extremity can receive a pulley for driving additional equipment, such as a water pump or an alternator.

The oil pump body and the injection pump body are disposed perpendicular with respect to one another on the outside of a given housing filled with fuel which is used to house the camshaft which collectively controls them and with the same cams. The recall of the oil pump pistons is effected with compression springs, whereas the drive of the injection pump pistons is of the desmodromic type with the aid of a half-ring ended at its extremities by two elements with internal flat bearings perpendicular to the movement of the piston and intended to be in contact with the cam. One rod corresponds to each internal bearing: for one side, this is the pump piston and for the other is a guide ensuring a perfect guiding of the monoblock unit constituted by the half-ring and the two rods.

The housing, which receives all the pump bodies, is formed of two elements: the first element constitutes the body of the housing and is mainly used to house the cam and the two half-rings of the injection pump pistons. The mounting of the injection pistons is effected slanting from the opening and the position of the pistons is given by the housing of the injection piston guides in the housing. Conversely, the position of the injection cylinders on the housing is given by the piston and from the guide. The hole of the housing around the injection piston possesses a large amount of play so as to facilitate mounting and allow the return of non-injected fuel at the end of injection. This return is effected between the cylinder and the cylinder covers and through cross-shaped apertures under the cylinder towards the hole in the housing around the piston.

As described above, the position of the cylinders on the housing is given by the pistons with the aid of the mounted guide with hardly any play in its housing at the bottom of the housing.

The cylinder covers are rendered integral with the cylinders by two screws which are also used to make them slightly rotate when the pump is adjusted on the test bench. This adjustment is made with the head slightly unlocked so as to free the cylinders which are sealed without any joint and the cylinder covers which are sealed with two toric joints. One toric joint ensures imperviousness with the housing and the other with the cylinder head. On tightening, the monoblock cylinder head for all the cylinders forms a block on the cylinders and the housing, the toric joints ensuring flexible imperviousness with the cylinder covers.

The cylinder head is a distribution element common to all the injection cylinders. This disposition ensures improved the rigidity and stability of the unit. In this cylinder head, a conical chamber corresponds to each piston, said chamber receiving the ball valve with its recall spring. Two outlets on this conical chamber are machined to communicate with two injectors (not shown) which shall feed an engine cylinder or combustion chamber with fuel. This disposition is extremely advantageous and the distribution is equal in terms of volume on the two injectors with the same injection pressure calibration.

The flowrate of the injection pump varies whilst the engine is running. This flowrate variation is obtained by a slanted ramp at the piston head. This slanted ramp blocks off an orifice on the cylinder of the piston. By making the piston rotate, this blocking off position is changed and as a result more or less fuel is injected.

The volume of fuel injected by a piston rise is included between a closing provided by the slanted ramp which pressurizes the volume, and an opening which releases the volume pressure and which corresponds to the end of injection. The end of injection is a point which always remains fixed. The start of injection is a point which varies with the slanted ramp; the more advanced closing is in the rise of the piston, the higher is the flowrate, and the more closing is pushed back in the rise of the piston, the weaker is the flowrate. This flowrate variation is given by the rotation of the piston on its axis so as to change the position of the ramp which is slanted with respect to the aperture on the pump cylinder.

One extremity of this aperture controls the start of injection and the other extremity controls the end of injection. Control of rotation of the pump piston on its axis is obtained by a needle welded on the half-ring of each piston.

This needle is completely parallel to the constant of the axis of the piston. This needle gears with the rack which simultaneously controls all the pistons.

In other words, the travel of the pistons of the injection pump is fixed and the flowrate variation is given by making the injection start point vary on the travel of the piston, as being the case on a large number of injection pumps.

The travel of the pistons of the oil pump is the same as that of the pistons of the injection pump, but the flowrate is constant for a given speed.

The injection pump flowrate is effected by an electronic regulator which prevents engine runaway. The electronic regulator, which is placed on the side of the pump, controls the rack which in turn controls the rotation of the pistons so as to vary the flowrate.

The second portion of the housing is formed by a cover used to house the rack. This disposition is notable in that:

- it is extremely easy to accurately house the rack;
- the mounting of the rack in its housing and on the needles, which form the link between the rack and the pistons, can be effected extremely easily by closing the housing with a few screws for locking the two portions of the housing.

By moving the rack longitudinally in its housing, the pistons are made to rotate on their axis and the position of the slanted ramp is changed which is located at the piston head and as a result the flowrate is modified. When it moves upwards, the internal hole of the piston opens on the aperture and this is the end of injection.

An electronic speed regulator is fixed outside the cover of the housing.

This regulator is placed behind the rack and they are connected together by a finger which forms part of the rack and is housed in the regulator.

The finger of the rack is perpendicular to the back of the rack and is situated in the middle of the back of the rack.

Placed on the face of the housing opposite the regulator and the open portions of the injection pump piston half-rings are the oil pump bodies without any flowrate adjustment. They suck up and deliver throughout the entire travel of the cam with dampening of the speed at the upper and lower dead points, which allows for functioning with the recall spring, even at high speeds. The oil pump piston and cylinder heads are independent and the circuit is independent on each cylinder. The functioning of the injection pistons is notable in that injection occurs with the use of a small portion of the travel.

This travel portion used for injection is situated on both sides of the half-travel of the injection piston during the period when the linear speed is the greatest. The rest of the travel provokes leaks which return to the housing via the aperture and the notches made on the cylinder of the injection pump piston. The free volume between the cylinder and the cylinder cover also participates in the circuit for return of fuel to the housing and this is the role of the cylinder cover.

The injection device is of the drawer type. The piston head is hollow and cylindrical. The central hole places the compression chamber in relation with a radial hole which opens with the travel of the piston in an aperture on the cylinder. On the piston head, there is a slanted ramp which adjusts the start of injection with respect to the same aperture on the cylinder.

The end of injection is a fixed point and identical on all the cylinders and pistons.

The start of injection is a mobile point which varies with the position of the slanted ramp at the piston head. When the start of injection moves forward and the end of injection remains fixed, the flowrate increases, and conversely when the start of injection moves backward on the travel of the piston, the flowrate reduces. As the flowrate increases, the forward movement on injection also increases.

Once the pump has been adjusted on the bench, it can be mounted directly at the end of the crankshaft on the engine.

It can be driven by small grooves which make it possible to easily position the start of injection on each combustion chamber with the forward movement at the desired injection. This final adjustment is obtained by making the pump pivot by means of the apertures on the housing, said apertures receiving the two screws for locking the pump. The fineness of this adjustment can be made during operation by slightly unlocking the two screws and keeping the pump functioning with the aid of a threaded rod screwed on the housing. This lever arm is used to overcome the pump drive force so as to find with the rotating engine the best possible injection point before relocking the two screws and unscrewing the lever.

This final adjustment possibility is notable in that it cannot be made with a conventional injection pump on which the dissipated force for its actuation is about four to five times greater than the pump of the invention.

BRIEF DESCRIPTION OF THE DRAWINGS

The advantages of the invention can be more readily understood from a reading of the following embodiment example with the aid of the following figures.

DESCRIPTION OF THE PREFERRED EMBODIMENT

Figure 1:
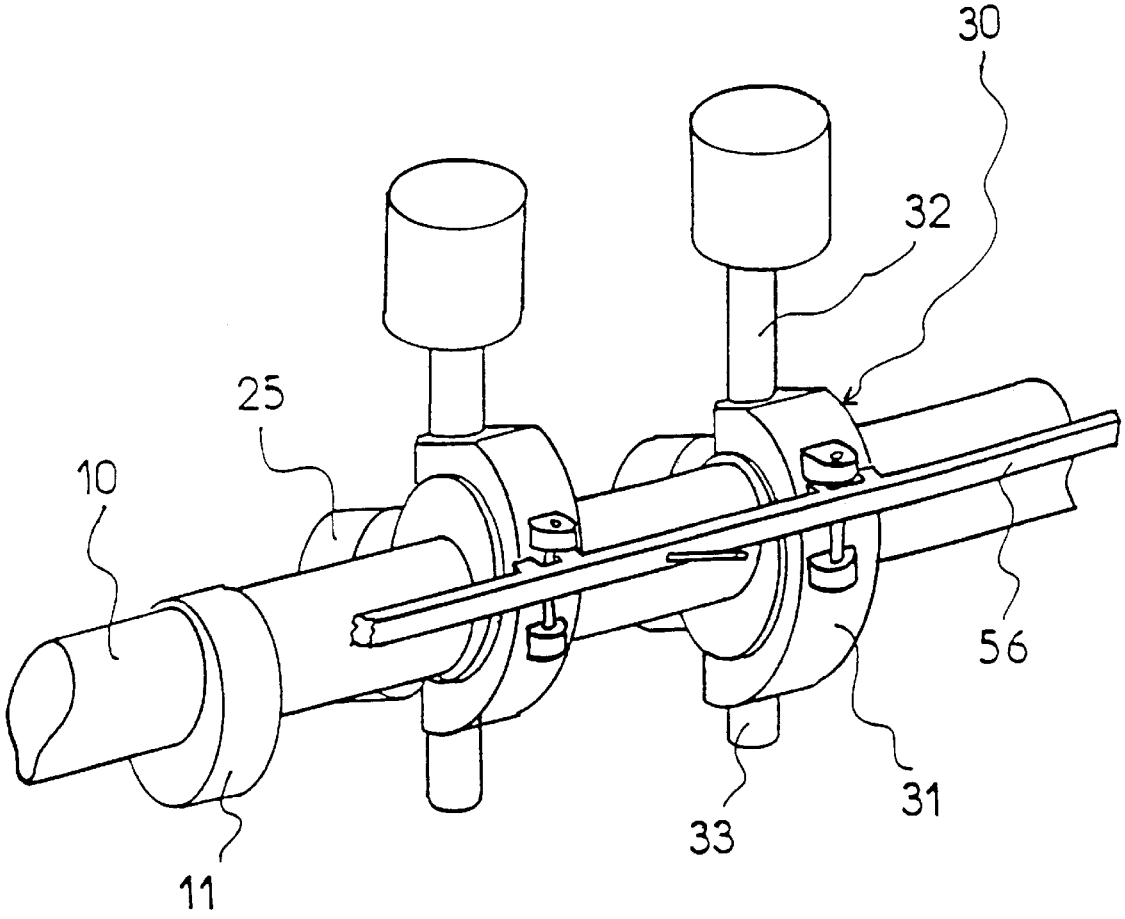
FIG. 1 is a perspective view of the camshaft equipped with injection pump pistons.
Figure 2:
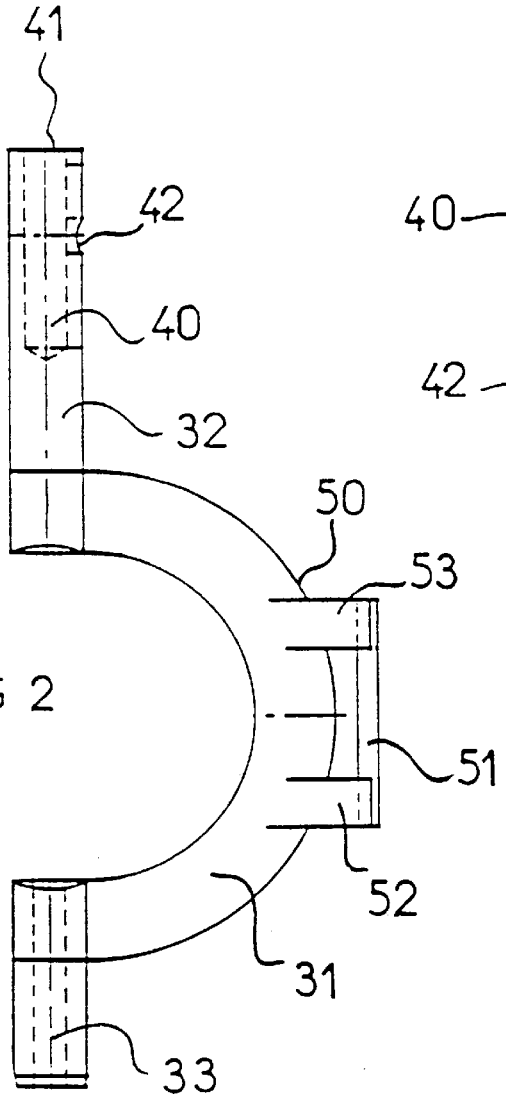
FIG. 2 is a side view of an injection pump piston.
Figure 4:
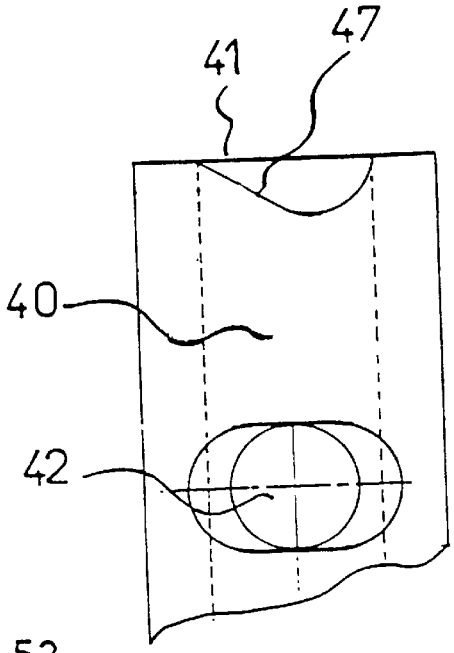
FIG. 4 is an enlarged detailed view of the head of the rod of the piston.
Figure 3:
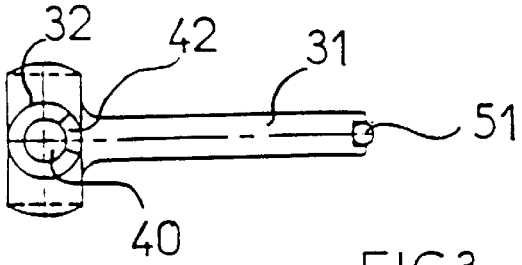
FIG. 3 is a top view of said piston.

The invention, as shown summarily on FIG. 1, combines an oil pump assembly (25) and an injection pump assembly (30) used in particular in a diesel engine, the number of pistons of this pump not being limited.

This unit includes a traversing camshaft (10), a set of cylindrical oil pump pistons (20) with valves, and a set of injection pump pistons (34) appearing in the general form of a half-ring (31) bearing at its extremities a piston rod (32) and a guide (33), both being coaxial. This unit is contained in a housing (15) (not shown on FIG. 1). The oil pump pistons (20) slide inside oil pump cylinders (21) fixed by a cylinder head (22) (not shown on this figure). Similarly, the injection pump piston guides slide inside the same housing (15). Finally, the injection pump piston rods (32) slide at their end part in a piston cylinder (35) surrounded by a cylinder cover (36) and surmounted by an injection cylinder head (37) (not shown).

Figure 5:
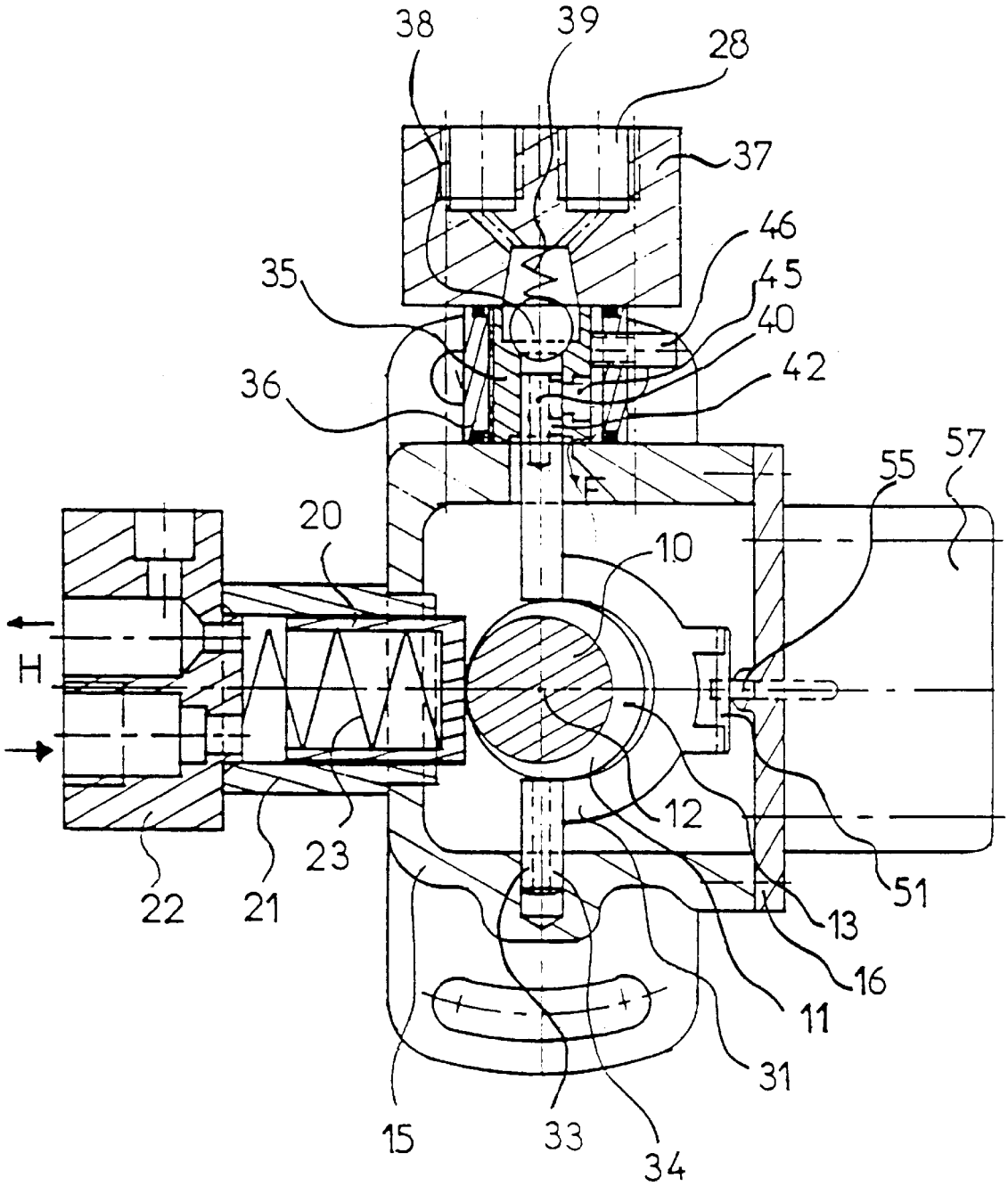
FIG. 5 is a general section according to a plane perpendicular to the camshaft.

FIG. 5 clearly shows the various elements in an assembled condition. This section shows the shaft (10) with cams (11) comprising as shown on FIG. 1 one cam (11). On one side of this cam, a hollow cylindrical oil pump piston (20) takes support, shown here in the position closest to the spin axis (12). This piston is able to slide inside a piston cylinder (21), by the movement of the cam (11) and recall (maximum on this figure) being ensured by a spring (23). The chamber of this piston communicates with a cylinder head (22) equipped with valves (not shown) ensuring the passage of oil along the marked arrows.

The injection pump piston (34) moves along a direction perpendicular to the piston (20) of the oil pump. This piston (34) is made up of three separate portions, namely a piston rod (32), a drive and linking half-ring (31) and a guide (33). The piston rod (32) moves inside a piston cylinder (35) so as to provoke the compression of a quantity of fuel and send it into the cylinder head (37) and as far as the injector through a ball valve (38).

This piston rod (32) is pierced with an axial hole (40) connected in the axis of half-ring (31) by a radial hole (42) which opens on the diameter of the piston and which controls the end of injection when it opens on the aperture (45) of the cylinder.

The cylinder (35) is imperviously surrounded by a cylinder cover (36). They are rendered integral by a screw (46). This screw (46) is used to change the position of the cylinder on the test bench and unlocked cylinder head (37) so as to angularly obtain the start of injection which is identical on all the pistons for any given position of the rack. The cylinder cover (36) is used to contain the end of injection leaks towards the housing according to the arrow F.

Secondly, the piston guide (33) is placed in the extension of the rod (32) of the piston on the other side of the camshaft (10). This guide (33) is mounted sliding inside the housing (15). The guide (33) and the rod (32) are connected by a half-ring (31) whose internal shape cooperates with the cam (11). In this way, when the cam (11) rotates, the portion moved most distant from the spin axis (12) of the shaft sometimes pushes the rod (32) so as to ensure the compression movement and the sending of the piston, and sometimes pushes the guide (32) so as to recall the piston. This preferred embodiment makes it possible to avoid using the recall spring.

On its outer face (50), the half-ring (31) bears a spindle (51) parallel to the axis of the movement of the piston and is spaced from the outer face (50) of the half-ring (31) by two arms (52, 53). This spindle (51) is intended to be translated by a recess (55) on the rack (56) driven by a speed regulator (57). Thus, the action of this rack (56) makes the piston (34) pivot around its axis with an alternative movement. The various pistons (34) placed all along the camshaft (11) are driven simultaneously by this speed regulator (57) and the rack (56).

During functioning, the camshaft (11) rotates driving a longitudinal alternative movement of the oil pump piston (20) which accordingly carries out its function. At the same time, the injection pump piston (34) also describes a longitudinal alternative movement which enables it to compress the fuel at the level of the compression chamber located under the ball valve placed on the cylinder (35).

Starting from the most withdrawn position of the piston (34), the movement follows the following phases.

First of all, the head (41) of the rod (32) of the piston is opposite the aperture (45) situated on the piston cylinder (35). Thus, the housing, the space between the cylinder cover (36) and the cylinder (35), the cylinder aperture (45) and the inside (40) of the rod of the piston are all in communication and thus at a low pressure.

Then the piston rod (32) starts to move inside the cylinder (35) and the head (41) of the rod leaves the aperture (45) of the piston cylinder (35). From this movement, the fuel contained inside (40) the piston rod and on this side of the valve (38) is compressed.

Then, with the movement of the piston (34) being continued in the same direction, the hole (42) situated on the rod (32) of the piston arrives opposite the aperture (45) of the cylinder (35). At this precise moment, the compression chamber is back in communication with the housing (15) and the pressure falls down again.

The adjustment of the flowrate is effected by rotating the piston rod (32) inside the cylinder (35). This rotation is obtained by acting on the rack (56) on the half-ring (31) which actuates pivoting. To this effect, the slanted ramp (47) is disposed at the head (41) of the piston rod (32). Depending on the angle of the piston (34) with respect to the cylinder (35) and thus to the aperture (45), the moment of placing opposite the ramp (47) and the aperture (45) varies. This makes it possible to adjust the flowrate and the forward movement on injection.

The multiple advantages of the invention shall appear more clearly from the preceding description. First of all, this unit makes it possible to have two pumps with a single drive, which reduces the weight and cost of this embodiment. In addition, as this pump does not use recall springs for its injection function, this makes it possible to have rotation speeds clearly greater than all currently existing pumps with less noise, heat generated and less dissipated power.

In addition, the use of a traversing shaft enables one extremity of said shaft to be used to actuate other devices.

I claim:

1. Device formed of two piston pumps for feeding two independent liquid circuits and in particular the fuel injection circuit and oil circuit for internal combustion engines, said device comprising:

(a) a single monoblock housing in which are fixed bodies of said two pumps, (b) a single drive shaft with cams for controlling the two pumps, (c) a set of oil pump pistons moving in a first direction, each oil pump piston cooperating with one of said cams to be moved away from said drive shaft, a spring recalling said oil pump piston, (d) a set of injection pump pistons moving perpendicularly to the said first direction of the oil pump pistons, each injection pump piston cooperating for thrusting and recall with one of said cams with the aid of a half-ring whose opening is directed towards a corresponding oil pump piston, and extremities of said half-ring respectively comprising a piston guide and a piston rod, said piston rod and piston guide being placed with one being an extension of the other, said piston rod sliding in a cylinder comprising an aperture which defines a start of injection with one slanted extremity of said piston rod and an end of injection with a hole provided on said piston rod.

2. Device according to claim 1 which comprises a monoblock injection cylinder head connecting said cylinders on said monoblock housing.

3. Device according to claim 1 wherein each said cylinder can move inside a cylinder cover whose position with respect to said cylinder is adjusted by a screw.

4. Device according to claim 2 wherein said monoblock injection cylinder head comprises, opposite said cylinder, a compression chamber receiving a valve and a recall spring for said valve, and opening onto a starting point of two injectors.

5. Device according to claim 1 wherein a control of variation of the flowrate of the injection pump is obtained by rotating said injection pump pistons on their axis, said rotation being controlled from the back of said half-rings on which two machined arms with a throat receive a needle welded parallel to the axis of the injection pump piston and able to cooperate with a rack disposed parallel to said drive shaft.

6. Device according to claim 5 wherein said housing includes a cover secured to a remainder part of said housing and which comprises a slide for said rack and an aperture able to allow a finger of said rack to pass.

7. Device according to claim 6 wherein said finger of said rack is controlled by a speed regulator secured to said cover of the housing.

8. Device according to claim 1 wherein said slanted extremeity of said piston rod, the hole provided on said piston rod and said aperture of the cylinder are disposed so that injection is effected on both sides of a half-travel of the injection pump piston when its linear speed is greatest.

9. Device according to claim 1 wherein one extremity of the said drive shaft can be connected directly to a crankshaft whereas another extremity of said drive shaft can receive a pulley to drive additional equipment, such as a water pump or alternator.

* * * * *